United States Patent [19]

Zur

[11] 4,258,445

[45] Mar. 31, 1981

[54] BEDS AND ADJUSTABLE BODY SUPPORTING ASSEMBLIES

[76] Inventor: Henry C. Zur, 10 W. Griswold Ave., Phoenix, Ariz. 85021

[21] Appl. No.: 41,354

[22] Filed: Aug. 1, 1979

Related U.S. Application Data

[63] Continuation-in-part of Ser. No. 911,749, Jun. 2, 1978, which is a continuation-in-part of Ser. No. 855,843, Nov. 30, 1977, Pat. No. 4,188,677, which is a continuation-in-part of Ser. No. 705,543, Jul. 15, 1976, Pat. No. 4,127,906.

[51] Int. Cl.[3] ..... A47C 21/00

[52] U.S. Cl. ..... 5/66; 5/69; 5/90; 5/446; 5/465

[58] Field of Search ..... 5/13, 63, 66–69, 5/90, 460, 465, 471, 446; 4/315; 297/284, 396

[56] References Cited

U.S. PATENT DOCUMENTS

| | | | |
|---|---|---|---|
| 2,247,516 | 7/1941 | Murray | 5/69 |
| 2,632,185 | 3/1953 | Eckart et al. | 5/90 |
| 2,887,691 | 5/1959 | Talarico et al. | 5/68 |
| 3,300,792 | 1/1967 | Spitz | 5/13 |
| 3,332,090 | 7/1967 | Witzler | 5/90 |
| 3,406,772 | 10/1968 | Ahrent et al. | 5/68 |
| 3,646,621 | 3/1972 | Fragas | 5/66 |
| 3,857,121 | 12/1974 | Rogers, Jr. et al. | 5/460 |
| 4,176,415 | 12/1979 | Dickerson et al. | 5/465 |

*Primary Examiner*—Casmir A. Nunberg

[57] ABSTRACT

An improved adjustable body supporting assembly which is distinguished by its capability to provide with a single power means the movement of a support and the additional movement of a pivoting second support portion in relation to the first such as the head serving upper back support portion by means of linkages, to base and the improved adjustable body supporting assembly which is distinguished by single power means moving the lower body supports from a horizontal to an upward slanted position of the leg support in combination with the aligned knee support, and of moving the leg support from its slanted elevated position through a horizontal position at an angle to the knee support to a position with the leg support pivoted downward for a regular sit-up position.

A variation of the embodiment serving especially for persons with cardiac or vascular problems, has power driven separate sides, each composed of a leg and knee support, and can be adjusted for separate positioning or programmed movement simulating walking movements to facilitate the hearts activity. The invention is also providing for more compact adjustable assemblies, moving from a wall hugging sit-up and elevated position to a full length bed. The embodiments also include an improved mode of operating a built-in toilet. A further variation, serving for human activities is provided with three separate adjustable lower supports, to facilitate various positioning of two occupants. The enclosed description of the objects of the invention and the description of the preferred embodiments of the various improvements serve to illustrate and explain said embodiments, but are not stated as limitations of the invention as various other embodiments can be developed.

19 Claims, 22 Drawing Figures

8
10
1
9
11
7
5
4
2
6
3

8
10

8
10
9
1
7
5
4
2
3

FIG. 7
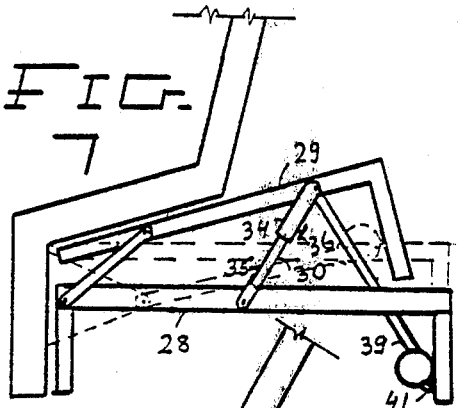
FIG. 6
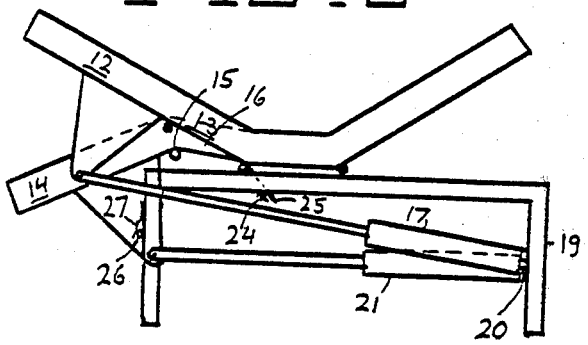
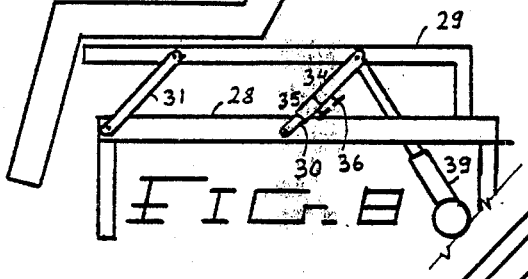
FIG. 8
FIG. 9
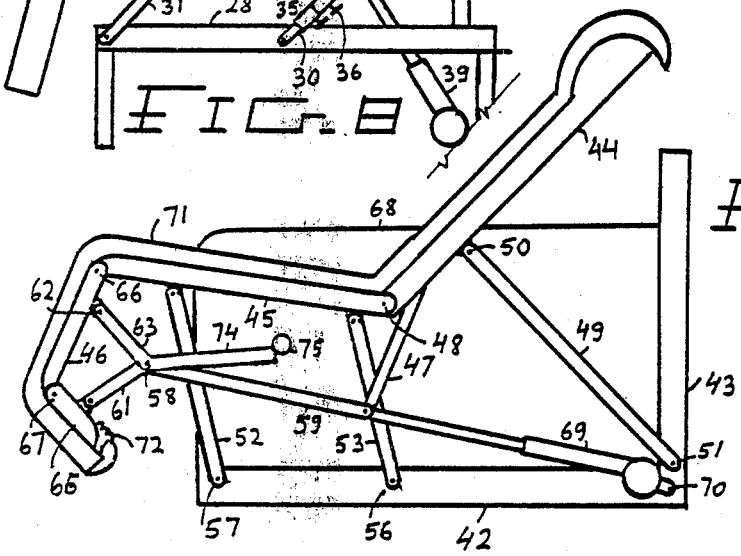
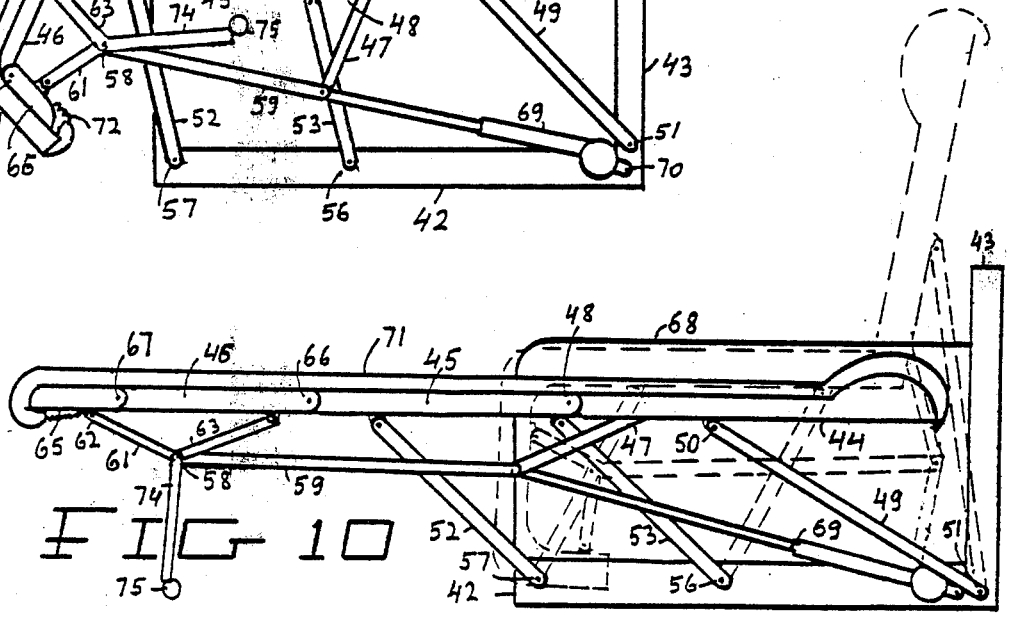
FIG. 10

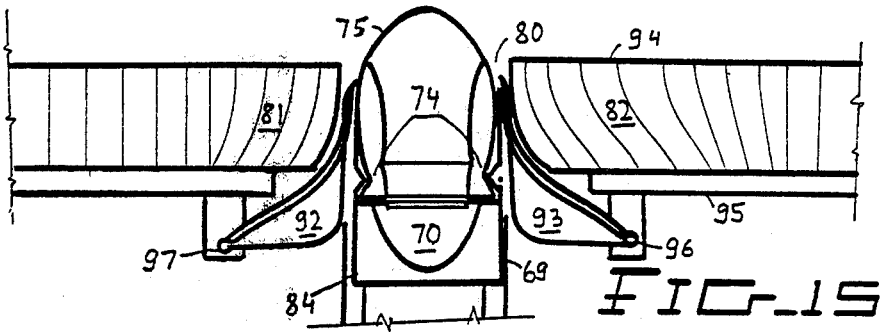
FIG. 15
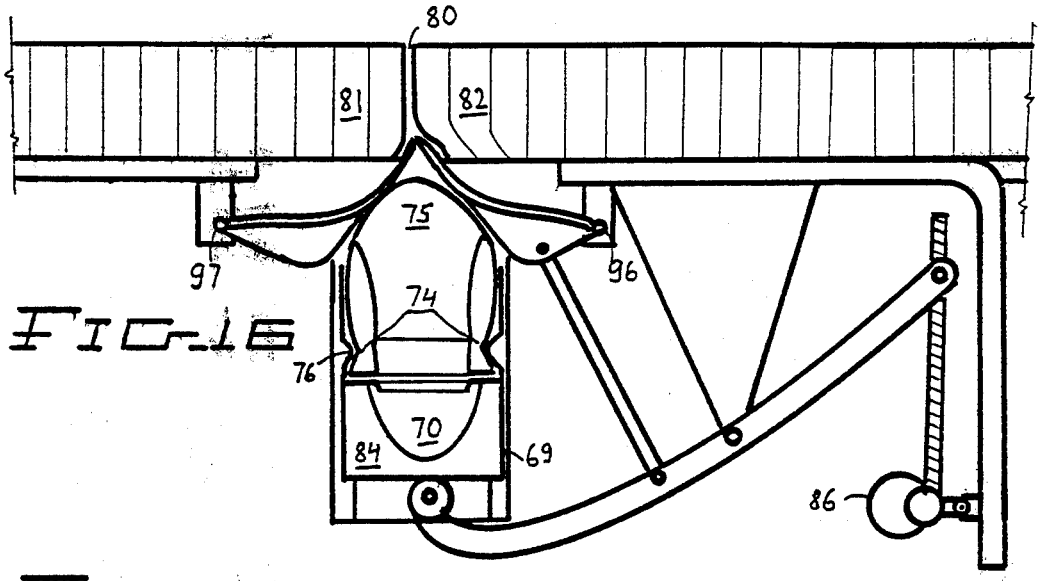
FIG. 16
FIG. 17
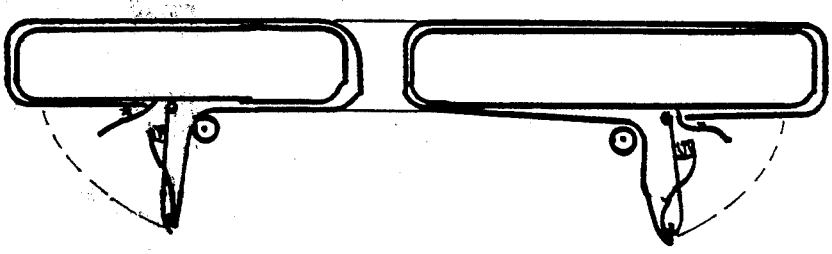

BEDS AND ADJUSTABLE BODY SUPPORTING ASSEMBLIES

RELATED APPLICATIONS

This application is a continuation-in-part of application Ser. No. 911,749, filed June 2, 1978, which was a continuation-in-part of application Ser. No. 855,843, filed Nov. 30, 1977 and is now U.S. Pat. No. 4,188,677, and which was a continuation-in-part of application Ser. No. 705,543, filed July 15, 1976 and is now U.S. Pat. No. 4,127,906.

BACKGROUND OF THE INVENTION

Adjustable body supporting assemblies such as positioning beds, adjustable Hospital-type beds and adjustable chairs have been known serving for various positioning of an occupant, but the art was singularely lacking assemblies providing for the separate positioning of parallel limbs at different angles or elevations. Another, and perhaps even more important factor, for which so far hardly any provision were made, is to provide a body resting on such assembly with certain movements which would be beneficial to the occupants health or improvement, but for which the person itself has no physical ability.

It has been a long established fact, that walking is very healthy and for certain diseases constitutes a rehabilitating factor, such as in the case of heart related afflictions where a proper movement of leg or knee increases the action of the hearts ventricles, providing for better breathing. However when persons are bedridden or physically not able to walk, providing a mechanically operated simulated walking movement to the lower body, would serve as the nearest available substitute for regular walking, and contribute to the rehabilitation or the prolongation of a persons life. Using a similar lowerbody movement for hospital patients combined with a preset programmed resistance would increase the use of knee and leg muscles and at least partly eliminate the weakening of these muscles, and thus in effect shorten hospitalisationtime, as in many cases patients feeling relatively well, have to remain in hospital because of their inability to walk resulting from their unused and weakened knee and leg muscles.

Another important factor was the absence of an adjustable movement of the leg and knee supports in regard to each other, and in relation to an middle support serving the posterior of an occupant, by one single power-means such as an screw-type motor. Usually the power-means served to elevate the knee support and the pivotally connected leg support attached to said knee support was raised in parallelogram fashion by means of pivotally mounted connecting arms, connecting said leg support for a horizontal movement to a supporting frame. Or as in the form of the above quoted applications the leg support was adjusted by a separate power means to provide a movement in relation to the knee support. Also it was not known to provide variable movements of the whole assembly by a single power stroke or pull, including a movement of the extending body supporting assembly from a wall, to save space.

Body supporting assemblies serving for persons which are either to handicapped to go by themselves to the bathroom, or persons which either temporarily or permanently are to sick or weak to go by themselves, need to perform their elementary needs in the bed, therefore body supporting assemblies serving for such persons must provide a remote controlled means, such as a built in toilet. While such devices were previously described and claimed, it has been found that an improved system could be designed to facilitate easier use and better operation. One of them is providing the upper part of the toilet with a deflector-type addition to prevent spilling from a forward directed stream by male occupants. Another is reducing the "seat" part, as actually the occupant remains seated on the bed and only needs a slit-type opening to perform his needs, in which case the upper part of the toilet is formed by the said deflector as part of an elongated ring, which is raised into the mattress opening. Another important need is to provide this said upper part as an disposable item, so that it can be replaced when dirtied or whenever a new patient is placed on said bed. Also it has been found that for some persons a easy recognizable positioning means is required to prevent dirtying of the linen. A new disposable upper part made of material such as hardened foam would not endanger the patient while coming up, but the deflector part extending above the mattress would serve a positioning means.

OBJECTS OF THE INVENTION

1. To provide body supporting assemblies with the improvement of one single power means serving both for the adjustable elevation of a body support in relation to the base, and for the adjustable relation of a further pivotally connected portion of said support in relation to the support.

2. To provide a simplified adjustable body support assembly with a transversely divided backsupport, whose upper and head supporting portion is pivotally mounted to the lower portion and by means of a linkage extending to the base creates for the upper portion a forward inclining movement of the head portion in relation to the lower portion when lower portion is raised by power.

3. To provide a body supporting assembly with the improvement of a single power means moving the knee support in relation to the base and progressively moving the leg support pivoted to said knee support into and through various positions fro elevated and slanted to lowered at an angle facilitating a sit-up position.

4. To provide such assemblies in multiple form to serve as adjacent structures.

5. To provide such assemblies with means such as springs or gas-filled cylinders which will enable the occupant to operate without power means, by shifting.

6. To provide an improved and simplified operation of hospital-type beds, by mounting the support assembly on parallelogram-type arms to the base and providing the arm to which the power-means are connected with an adjustable length, so that not only elevation is achieved but also an adjustable slant.

7. To provide simplified variations of the assembly serving both as adjustable loungers and as beds when adjusted to a flat and rolled out position.

8. To provide such body supporting assemblies with an improved built-in toilet operating both the toilet and the mattress opening with one single power means, synchronizing the movement and reducing dangers.

9. To provide such built in toilet with a disposable or replaceable upper part formed with a upward extention serving as a downward deflector for males, and whereby the upward moved extention over the mattress level helps the occupant to position himself properly over the toilet.

SUMMARY OF THE INVENTION

Providing an adjustable body supporting assembly with a single power-means operated knee and leg supports system is accomplished by such simple expedients as connecting the pivotal connections of the leg support to the knee support and also if desired connecting the pivotal connection of the knee support to the middle support, with spring loaded hinging-means and mounting one end of the power means to the leg support and the other end of the power means to the supporting panel or frame. Thus if the power means such as a fluid operated cylinder and piston or a motor driven screw is extended from its shortest position, in which the leg support can be pulled downward and below a horizontal body supporting level, the leg support will be raised while the knee support remains in an angled position in relation to said knee support, until the leg support is aligned with the knee support. The spring loaded hinging means secures now the leg support to remain in a aligned position with the knee support, and the retracting power means lowers the aligned knee and leg supports until it reaches a level position with the body supporting assembly, at which position the knee support is stopped by restraining means, and further retracting of the power means causes now the leg support to continue downward, facilitating sitting-up and entry or exit. An mattress wound around the legrest-end serves for an uninterrupted support.

Providing now two separate power arrangements as described to two separate knee and leg supports for each side of the body supporting assembly will enable the occupant to assume selected separate positions on each side of his lower body. These separate support sides can now be provided with mechanism which will in effect give the occupant a walking motion and programmed for a selected stroke and timing. This type of exercise is considered very beneficial to handicapped persons who can not exercise by themselves, and would benefit from such action as pressures on the veins, which serve to support the pumping action of the heart. Providing a variation of such assembly with with three adjacent lower adjustable supports, will facilitate many human activities, by permitting the lowering of the median support for various positions.

A further variation of this improvement entirely new important results in the form reduced space requirements, single power operation of the whole adjustable support assembly, and an elevated sit-up position which facilitates getting in or out of the assembly. The push and pull rod extends in a simplified variation from an downward extention of the back-support to the leg support, which in turn is pivotally connected to a knee and middle support. Said middle and knee support is mounted on pivoting arms to the base. The back support is also mounted on pivoting arms to the base, while pivotally connected to the rear end of said middle support, in a manner that a push on said push and pull rod causes the back support to move from a vertical position through reclining positions to horizontal positions. At the same time the middle support moves forward, and the leg support is moving from a vertical position to through various positions of slant to a horizontal position.

As is evident this push and pull movement can also be accomplished by the occupant himself, especially when the support movement is assisted by means such as springs or gas filled cylinders, without resorting to any powered means.

It is also evident that the height of the sit-up position can be predeterminated by the length an pivotal positioning of the pivoting arms connecting the middle and knee support to the base. However for reduced sit-up height, the leg support can be divided into two transverse portions, pivotally connected to each other. In this case the separate portions are connected by separate arms in a manner which causes a retracting pull of the rod to fold the lower portion of the leg support inward, and a pushing movement to fold said lower portion out when the leg support is elevated. The arm connecting the said rod to the upper leg support portion can extend with a caster to the floor when leg rests folds out.

The improvement whereby one power-means serves for the adjustment of the knee support and the leg support together or to change their relative position to each other, and also accomplishes a sit-up position for the whole body supporting assembly is of special importance when said assembly is provided with a built in toilet, as a sitting up position serves to facilitate the bowel-movement. However to serve both for sitting up and facilitate the entry or exit of an occupant his legs must be able to reach the floor, therefore the built-in retractable toilet has been improved to require only a relative low height of the body supporting assembly off the floor.

Furthermore in order to permit the leg support to move downward an improved toilet arrangement is introduced so that a downward retracting portion will not interfere with the leg support. This has been solved by the arrangement whereby the retracting mattress insert has an elongated form and swings downward to one side of the body supporting assembly thus not taken up any space to the foot-side of the bed, and by a new type of toilet with an upper part made with a deflector-type extension. This upper part is replacable as disposable item made from material such as hardened urethane foam and when the toilet is raised into the opening of the mattress, the deflector-type extension raises above the mattress level and provides the occupant with an easy recognisable positioning means. However this part being somehow resilient it will rather be compressed or break away than hurt the occupant. To minimize the possibility that a very thin occupant may slide into the opening of the body supporting assembly while the mattress insert is retracting downward, and the toilet is coming up into said opening, an improvement has been made whereby fluid or electrically operated cut-offs shut of the power to the mattress and toilet arrangement, unless the body supporting assembly assumes a horizontal position, with any adjustable supports aligned. Once the occupant has by remote control moved either the mattress insert or the toilet into the mattress-opening, he can make any desired adjustment of adjustable supports. In a further improvement the sides of a slit in the mattress move aside while a toilet moves in rails from a sideward covered position into a slit.

The use of one power means for two purposes of body positioning adjustment by means of improvements of the mechanism holding and moving the supports is of especial importance in the creation of a separate movement of the occupants head by means of linkage of a separate head support portion pivoting from the adjustable back support. The linkage is pivotally mounted to the frame serving as base, in a manner which gives the linked head support an elevating movement in relation to the back support, when the back support is elevated, and the more the back support is elevated, the more the head supports begins to incline forward, thus producing the required positioning and angle for a occupants head when engaged in activities such as TV viewing or reading.

This improvement of a progressively forward inclining headrest will eliminate the strain and following pains suffered by many persons watching TV in bed, for although TV is now with most people the greatest leisure activity by far, no real accomodation was made for so far, with many disastrous results.

Providing an improvement of securing the mattress to adjusting beds is necessary as present holding systems, mainly a bar at the end of the bed, are not capable to hold a mattress of an adjustable bed in place. The improvement of providing straps encompassing the supports, or the flaps permitting mounting and reversal will eliminate many troubles caused by moving mattresses.

Providing an adjustable body support assembly with three adjacent lower assemblies will facilitate many important human activities, which require not only elevating positioning but also the lowering of a support area. Variations of this assembly will serve for improved family life, while other variation can serve to provide for the insertion of a bedpan in the lowered area, thus facilitating the requirement when necessary.

DESCRIPTION OF DRAWINGS

FIG. 6 is a view of the embodiment with two adjacent lower supports.

FIG. 7 is a side view of the embodiment incorporating an elevating means for the whole assembly with an adjustment for slant.

FIG. 8 is a view of the embodiment of FIG. 6, with the paralellogram-type arms elevating the assembly horizontally.

FIG. 9 is a side view of the single power-means embodiment reclining.

FIG. 10 is a view of the embodiment of FIG. 9, with the assembly slid out.

FIG. 15 is a sectional view of the new toilet rim pushing upwards.

FIG. 16 is a sectional view of the new toilet retracted downward.

FIG. 17 is a sectional view of the mattress slit pulled open.

PREFERRED EMBODIMENTS

Figures 1, 2, 3, 4, 5:
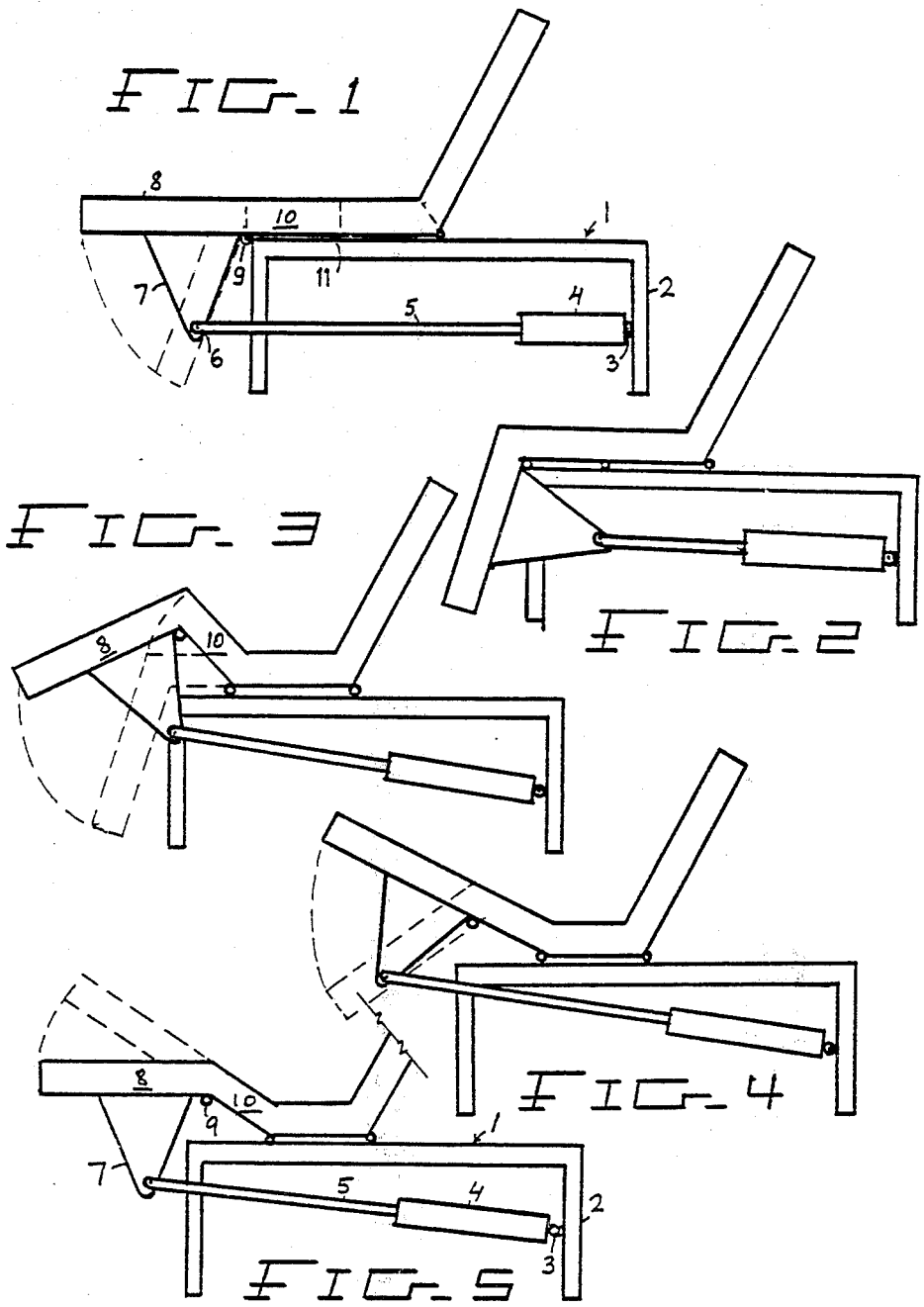
FIG. 1-5 show a perspective view of the embodiment using one power means to move the knee support with its pivoting leg support into a variety of positions in relation to base and each other.

A simplified embodiment of the single power-means feature for the adjustable elevation for the knee and leg support together or in relation to each other is shown in FIG. 1. In FIG. 1 a supporting panel or frame 1 is provided with an downward extending member 2 which may also be the leg. A fluid operated cylinder 4 is shown mounted pivotally at 3 to the member 2. A pushrod 5 is extending from the piston in the cylinder 4 and is in turn pivotally mounted at 6 to an downward extending member 7 of the leg support 8. This legsupport is pivotally connected by a spring-loaded hinge 9 to the knee support 10 which is pivoting at 9. When fluid is directed by remote control for an inward stroke to the cylinder 4, the pushrod 5 retracts and causes the legsupport to pivot downward creating a sit-up position as shown in FIG. 2.

Is now the fluid directed into the cylinder for an outward stroke the leg support is pushed upward while because of its spring-loaded hinging mounting, retains an angled relation to the knee support 7 as in FIG. 3 until said knee support is restrained as in FIG. 4. The raise continues until a spring-loaded pivoting mechanism 9 snaps the supports 8 and 10 into an aligned position shown in FIG. 4. Is the fluid now directed for inward stroke, the leg support with the presently aligned knee support will move downward into a horizontal position, as in FIG. 1. The knee support 10 is restrained from further downward movement by the frame 1 and thus when further inward flow is provided to the piston and rod, the leg support will pivot downwards. Thus can a variety of position been achieved with the same power-means, whether it is a fluid operated piston and cylinder or a motorized screw-drive.

The same operating means serves for a body supporting assembly with two separate lower body assemblies of pivotally connected knee and leg supports, as shown in FIG. 6. The left side leg support 12 and the knee support 13 is raised in common alignment while the right side leg support 14 is lowered from its spring-loaded pivoting point 15 mounted to the right side knee support 16 The power means in this case shown as a fluid driven piston 17 serving for the left side movements separately is pivotally mounted to the frame member 19 at 20, while a similar power drive 21 serves the right sided supports 14 and 16 and is pivotally connected with its other end at 22 to a member 23 extending from the leg support 14. It is evident that both in this divided supports variation and with undivided supports one power means serves to achieve a plurality of positions, including a very important sit-up position so far not accomplished in such form and with such simple means, and that the divided supports when operated separately achieve a simulated walking movement. This can be accomplished by pushing alternatively different buttons of a remote control, or preset to a special circuit which alternately moves each side, by means of cut-outs serving to reverse the direction or/and activate the other side of supports. Adjustment of usual type cut-outs as provided in many motorised screw drives would limit the length of the stroke, and when fluid operated drives are used, the amount of fluid and pressure could be regulated to provide a stroke of a desired length and the following reversal of movement.

As shown in this embodiment cut-outs 24 and 26 are shown activated by an adjustable member 25 or 27 to provide a limit to the desired stroke of the respective supports and also serve for the alternate movement of each side and reversal of stroke. The spring loaded hinging connections of the supports or separate spring or retracting devices could provide for increased musclestrain. To provide this embodiment with adjustable elevation shown in FIGS. 7, 8 as may be required for treatment by attending personal, a base 28 has been added to the supporting frame or panel 29 and is connected to said member by pivoting arms 30 and 31 at 32 and 33, and power drive 39. One arm 30 is composed of two members 34 and 35 which slide in each other and are provided with a securing screw 36. Using the power driver 39 and loosening the screw 36 will provide a lengthening or shortening of arm 30 and create a desired slant of the body supporting assembly, once the screw 36 is secured for a desired length of the arm 30. Alternatively the arm 30 could be extended with a screw. A motorized screw drive 39 is pivotally connected to support panel 29 and with its other end to base 28 at 41, and serves for the adjustable elevation.

EMBODIMENT WITH MOVEMENT OF WHOLE ASSEMBLY WITH SINGLE POWER MEANS

FIGS. 9 and 10 show an embodiment in which the adjustment of all pivotally connected body supports from a bed-like horizontal position through variable reclining positions to an elevated sitting position is achieved by on single power stroke and vice versa, and within the additional space saving feature of the whole assembly retracting into a sitting position of less than half the length and remaining stationary near a wall.

The retracted assembly providing for a recline position is shown in FIG. 9. A back support 44 is pivotally connected to a middle support 45 at 48. A pivoting arm 49 connected at 51 to member 43 of the base 42 is mounted pivotally at its other end to the back support at 50. The middle support 45 serves as support panel similarily to frame or panel 1 in FIGS. 1–6 and is supported by arms shown as 52 and 53 which are pivotally connected at 54 and 55 to the support 45, and at their other ends to the base 42 at 56 and 57. A divided leg support composed of the upper portion 46 pivotally mounted to the middle support 45 at 66, and the lower portion 65 pivotally mounted to the upper portion 46 at 67. An extension of the back support shown as member 47 serves for a pivotal connection to member 59, which in turn is pivotally connected at 58 to members 61 and 63 which are pivotally connected respectively at 62 to the upper leg support portion 46 and to the lower portion 65.

An elongated armrest 68 is seen behind the middle support 45 which has assumed an elevated position at the end of the retracting stroke of the power drive 69, to facilitate the getting up as elderly or weak persons find it hard to get up from low recliners and sofas. Once the occupant has sat onto the retracted assembly, he can activate by remote control a forward stroke of the power drive, assuming first a reclining position as shown in FIG. 9 and continuing through a variety of positions into a fully horizontal position. It is evident that a single power drive 69, which is connected to the base at 70 provides the push and pull to member 59, and consequently all related movements. The divided leg support feature composed of portions 46 and 65 provides for a full length leg support with the portion 65 folding back in order to be accomodate within the seating height which is usually shorter than the required full length leg support. The folding out is here accomplished in a new manner by having the member 59 pushing on the arm 63 to elevate the upper portion 46 of the largest and a continued outward movement of the member 59 will transfer the push through member 61 to the lower legrest portion 65 and fold it out in alignment with legrest portion 46, and similarly with a retracting powerstroke fold the lower legrest portion 65 below the middle and seat support 45. An upper layer of upholstery is shown as additional feature in FIG. 9 & 10 which is wound around the end of the lower leg support portion 65 and secured with extendable material 72 such as rubberbands 73 to the inner side of the support and thus provides the mattress like formation covering the whole body supporting assembly with a tightening means. The upper end of this mattress like upholstery may similarly be secured around the end of the back support or slipped over it, thus creating an uninterrupted and thight upholstery in any position, eliminating such seating related problems such as blood-circulation decreases due to divided supports pressing agents the calves. An additional feature is shown as leg-type extension member 74 of the arm, which with its attached caster 75 moves downward to support the extended assembly.

Figure 14:
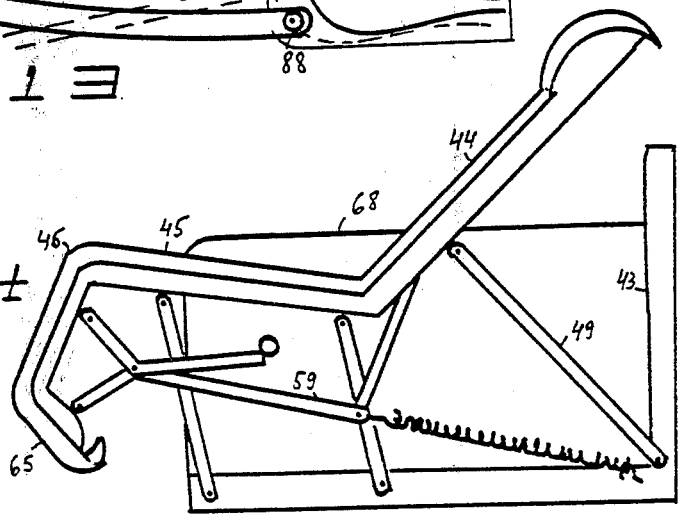
FIG. 14 is a side view of the embodiment of FIG. 9, 10, spring operated.

A further variation of this embodiment is shown in FIG. 14. In this embodiment the power drive is replaced by a mechanism similar to these employed presently in recliners assisted by means such as springs or gas-filled cylinders whereby the occupant provides for the movement by moving certain parts of the body or/and a supporting push or pull on the armrests 68.

EMBODIMENT WITH BUILT-IN IMPROVED TOILET

Figure 11:
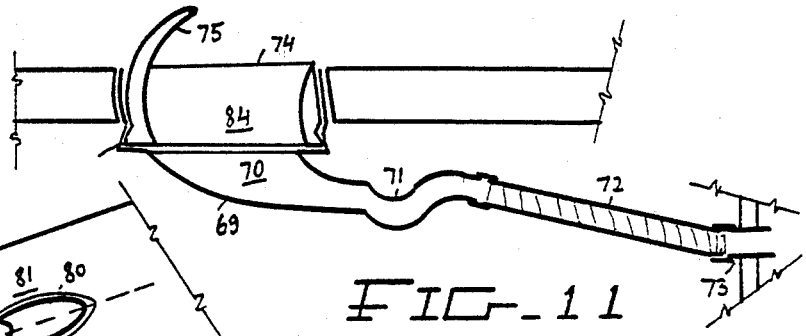
FIG. 11 is a sectional view of the new toilet upper rim with deflector.
Figure 12:
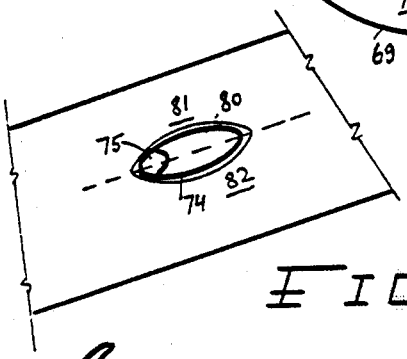
FIG. 12 is a perspective view of the mattress slit opening into an oval.
Figure 13:
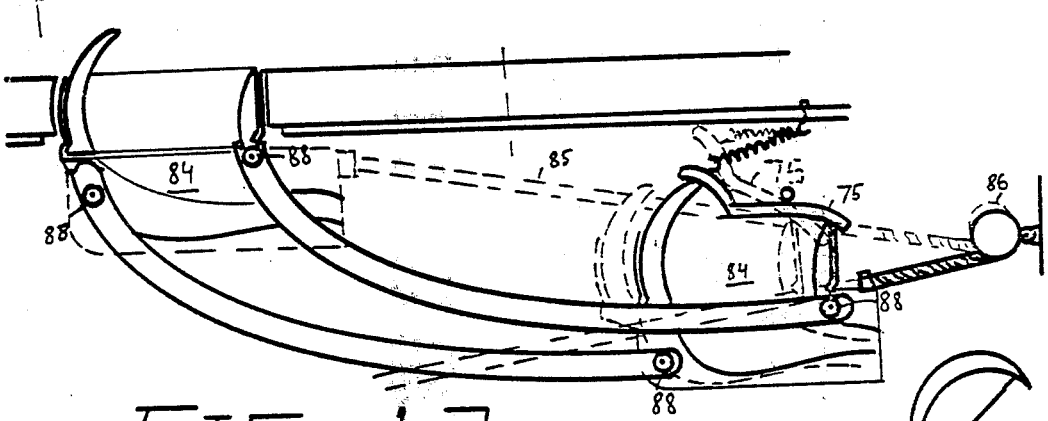
FIG. 13 is a sectional view with the new improved toilet, sliding from an elevated position to below the cover.

In order to provide an adjustable body supporting assembly both with a built in toilet and a sit-up position facilitating entry or exit various improvements were developed so that the assembly would be comfortable and the occupant would be able to position his feet onto the floor, once the leg support had been lowered from its pivotal position aligned with the knee and middle support. FIGS. 11, 13 & 15 a design of a new type of toilet is seen composed of a lower portion 69 which contains a bowl 70 connected by an traplike feature 71 serving to restrict odors from the flexible hose connection 72 and the wall outlet 73. The toilet shown here in its retracted position has reached with its upper portion 74 made from material such as hardened foam in FIG. 13 a pivotally connected cover 75 which is, by the continued retracting movement of the toilet forced into a horizontal position enclosing the opening of toilet, at the same time a spring loaded lever is pushed activating a programmed water flush into the toilet bowl 70, said flush originating from a flexible hose connection to a water main outlet.

Said upper portion 74 of the toilet serves mainly as rim for the slit like opening, as the mattress itself serves as seat instead the seat of conventional toilets, and is made of disposable material so that it can easily be replaced when dirtied or when occupants change. It is as shown in FIG. 11 formed with an protruding part 74 and is held in position on the toilet by being pushed in and held by a protruding part 76 of the toilet. A deflector-type part 75 is extending upward from said upper portion 74 and serves to deflect a possible formed directed flow downward, however also, as a positioning means. For it is evident that an upward movement of the toilet into the mattress opening will cause said deflector type extension 75 to extend between the legs of an occupant. The occupant will feel the upcoming deflector 75 and adjust his legs to both sides, and thus positioning himself properly over the slit 80 which serves as opening, while slit sides 81 and 82 provide in this improved version the seating support and reduce the size of the opening, for the occupant actually remains seated on the mattress.

To insure that the movement of the retracting mattress sides 83 operate fully synchronized with the upcoming toilet 84 and vice versa, usually a complicated cut-out system is required. A new improvement developed eliminates such system by using one power stroke to move both the toilet and vacate a slit by the simple expedient of a connecting member 85 serving as push and pull rod and connected either indirectly as in FIG. 15, to the power drive 86 is used to provide a pulling movement on sides 81 and 82 by such means as pulling a sheet like material, 89 by means such as clamps 90 & 91 in scissor like form apart.

In another variation of this embodiment the slit is widened by means such as specially formed parts 92 and 93, whose upper end stick into the lower part of the slit 80 of the mattress 94. Parts 92 and 93 are pivotally mounted to the bottom side of the mattress support 95 at 96 and 97 respectively. When these parts are pushed upward either by the upcoming toilet itself or through a connection of the toilet moving mechanism, said parts assume a vertical position having pushed the mattress sides 81 and 82 apart, vacating an opening for the toilet to move in.

VARIATION WITH PROGRESSIVELY FORWARD ADJUSTING HEADREST

Figure 18:
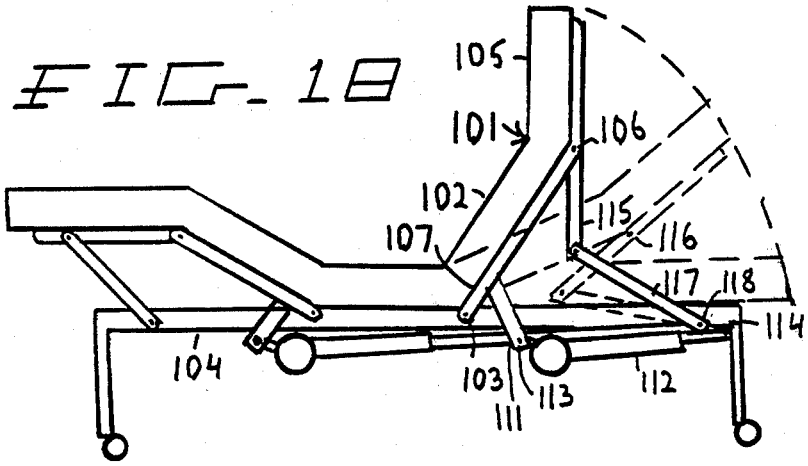
FIG. 18 is a side view of the embodiment incorporating the inclining head support through linkage to base frame.
Figure 19:
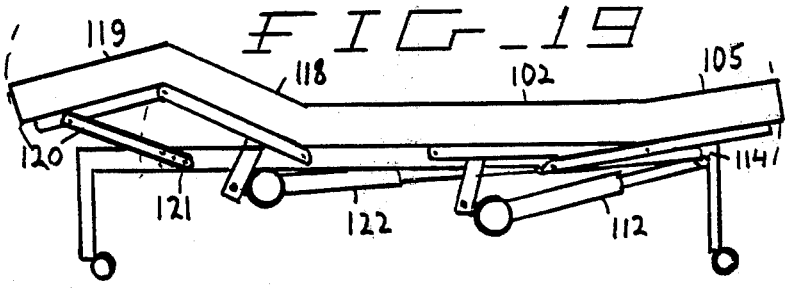
FIG. 19 is another side view of the embodiment of FIG. 18, with the back support horizontal and the head support inclined, and the leg support having a linking member with variable adjustment.

An improved adjustable body support assembly is shown in FIG. 18 and 19. The back support 101 is divided transversely into an lower portion 102 pivoted at 103 to the base frame 104, and into an upper portion 105 pivoted to said lower portion 102 at 106. A support frame 107 shown in FIG. 18 is made up of long members 108 and connected by member 110. This member 110 is provided with an downward extention 111 into which one side of a screwdrive 112 is secured at 113. The other side of the screwdrive is secured to member 114 of the simplified base frame 104 to provide an elevating movement to the back support 102 lifting at the same time the upper portion 105. An downward extention 115 of the said upper portion 105 is connected at 116 to a link 117 which is pivoting at 118 to the base frame, and thus causes the upper support portion 105 progressively to incline forward when power means 112 pulls this support upward.

To achieve with one power means both the movement of the knee support 118 an a variable movement of the leg support 119 the linking member 120 is pivoted at its one end to the leg support 119 and to the base frame 104 with one of the pivoting holes 121 provided at its other end. This hole and the corresponding pivoting hole in the base frame 104 are distanced so as to achieve a complete horizontal alignment of the leg support 119 with the knee support 118, when said knee support is lowered by means of the power drive 122. While the leg support is in its flat and aligned position with said knee support the pivoting bolt can be transfered to another set of corresponding pivoting holes in both the linking member 120 and the base frame 104, and thus produce a desired different movement of the leg support 119 in relation to the knee support 118.

As shown also in FIG. 19, the continuing push of the screw drive 112 will draw the lower back support portion 102 to a final downward position thereby causing the upper portion serving as head support 105 to tilt upward from its aligned position with the back support 102, because the base frame member 114 restrains the downward movement of the upper part of the head support 105.

Figure 20:
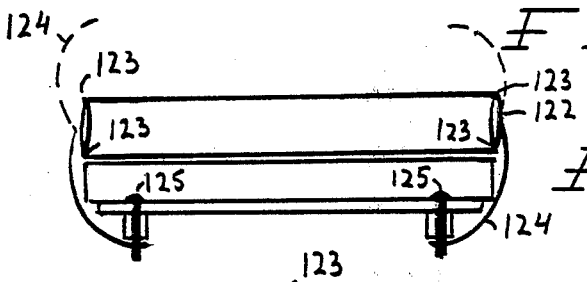
FIG. 20 is a sectional view of the mattress holding improvement with flaps.
Figure 21:
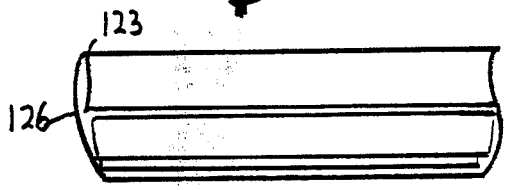
FIG. 21 is a sectional view of the mattress holding improvement with straps.

To overcome the moving of the mattress when the adjustable supports are operated the improvement of securing the mattress to the frame is shown in FIG. 20 and 21. A wide strap 122 is attached to both edges 123 of the mattress, and its median position extends outward as flap 124 which can be attached to the bolts 125 sticking out below the base frame 104. In FIG. 21 a wide srap 126 is attached to the upper mattress edge 123 at one side and to lower edge of the mattress at the other side, permitting mattress reversal.

EMBODIMENT WITH THREE INDIVIDUAL ADJUSTABLE LOWER SUPPORT ASSEMBLIES

Figure 22:
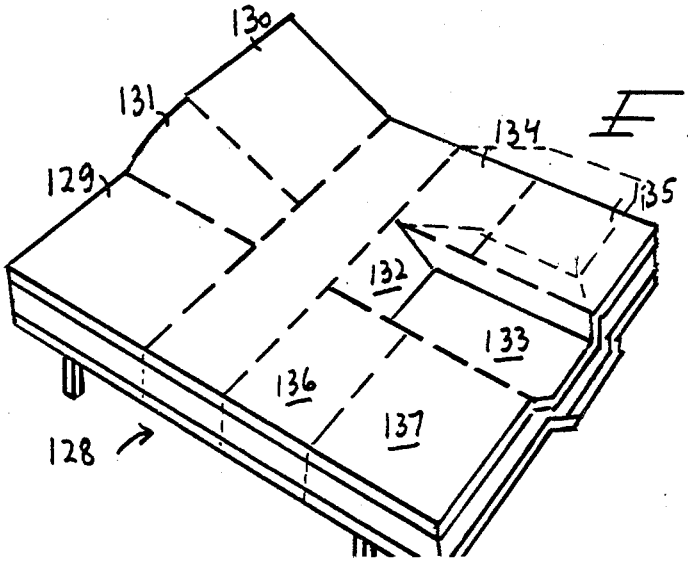
FIG. 22 is a perspective view of the embodiment with two adjacent adjustable assemblies and an additional median lower adjustable assembly.

In FIG. 22, a body supporting assembly comprising adjacent adjustable assemblies for each side is shown with the additional median lower assembly whose knee support 132 is turned downward forming together with lowered leg support 133 a lower level facilitating human activities and or insertion of a bedpan. At the same time the other adjustable supports 129, 130, 134, 135, 136 and 137 can be adjusted on each side, while the gap between upper supports 131 is bridged by flexible material or the joint flexible mattress.

What is claimed is:

1. A variable body support assembly composed of pivotally connected supports and distinguished by a single mechanism or power means such as a fluid driven piston in a cylinder serving to move, the leg support member of the assembly both for the adjustment of said leg support in relation to a knee support, and for combined adjusting movements of both said leg support and its connected knee support simultaneously in relation to other portions of the assembly and whereby the adjustable assembly accomplishes with a single mechanism to have the leg support moved by said mechanism from a position wherein the said leg support is pivoting downward from the knee support with the occupants legs downward to the floor, to a elevated position as continuation of the knee support, and wherein a movement by said mechanism elevates said leg support together with the knee support to an upward and slanted position, and wherein a movement of said mechanism causes said leg support to pivot downward together with the knee support until the knee support is restrained from further downward movement by means such as coming to rest on an assembly member, to facilitate positions such as sitting up, and whereby a variety of other positions can be achieved.

2. The assembly of claim 1, wherein spring loaded and or snap-in mechanisms assist to hold the knee and or leg support at a desired relation for a combined movement until the knee support movement is restrained by holding devices facilitating a continuing movement of the leg support.

3. The adjustable body support assembly of claim 1 wherein said lower body supports are composed of two adjacent knee supports and two adjacent leg supports and each side is provided by a separate movement means to provide separate positioning of an occupants lower body members.

4. The adjustable assembly of claim 3,
where each side is provided with a movement means such as a motorized screw drive or a fluid cylinder and piston and said power means are furnished with a programming mechanism to create a desired movement of the knee or leg supports providing the occupant with a simulated walking movement facilitating such beneficial and rehabilitating activity such as blood circulation, heart pumping and muscle use.

5. The adjustable assembly of claim 3, wherein each of the adjacent leg supports are connected with pivoting arms to a power driven mechanism provided with wheels onto which said arms can be mounted eccentrically and adjusted for the desired stroke and movement of each leg support by the distance from the center, or for a desired combined and aligned movement of both support sides when these sides are not serving for separate movement.

6. The assembly of claim 1 together with an uninterrupted surface of the pivotally connected body supports wherein a downward extending member of the back support portion is pivotally connected to a member such as a push rod moving the leg support portion, and whereby the single mechanism serves to provide simultaneous movements of the whole body supporting assembly from horizontal to a sit-up position and vice versa and in between positions.

7. The assembly of claim 6,
wherein the movement of the whole assembly and the change of the various supports in relation to each other is accomplished by various movements of the occupant such as shifting his body and weight on the assembly.

8. The assembly of claim 1,
wherein the leg support portion is composed of two pivotally connected parts, both connected by means such as pivotally mounted arms to the said mechanism in a manner which causes the lower leg support part to fold at an angle to the upper leg support part and reduce the required sitting height when a sit-up position is assumed.

9. The assembly of claim 1, wherein an additional power means such as a motorized screw drive serves for the adjustable elevation of a back support.

10. The adjustable body supporting assembly of claim 1
wherein the middle support portion or frame is mounted pivotally to the base such as in a parallelogram type manner to pivoting arms extending from the members serving as base and is provided with an additional power means such as motorised screw drive to provide adjustable elevation of the adjustable body support assembly in relation to the floor.

11. The adjustable body supporting assembly of claim 1, distinguished by a single power drive causing a combined movement of the leg support from an elevated and high position through various other positions to a sit-up position and wherein a built-in toilet moves to a slit like opening in the assembly, in synchronization with a means vacating said slit and vice versa both driven by a single power means such as a motorised screw drive and wherein a disposable material such as hardened foam forms a rim like inset which is put onto said toilet and secured to said toilet by means such as being pressed into a ring type upper part of the toilet and serves as rim type feature in the mattress opening coming upward into said opening when toilet is raised below said opening.

12. The assembly of claim 11, wherein the rim like disposable part put onto the toilet has at one side a deflector type upward extention serving both to direct a flow downward and also as orientation means, ensuring that a person positions himself properly over the opening with each leg at one side.

13. The assembly of claim 11, wherein for the purpose of reducing the relative height from the floor to the positioning level and to provide a space for a downward moving leg support, an elongated part vacating said slit is moved out and sideward from said slit opening.

14. The adjustable body supporting assembly of claim 1,
wherein an upper portion of the back support serving as head support is pivotally connected to the adjustable back support and is progressively elevated or forwardly inclined with and in relation to said back support by means of a linkages, connecting members of said upper portion serving as head support to members of a holding frame or base,
and whereby an elevating movement of the adjustable back support causes the head support portion to elevate more and at an angle to said back support, producing a forward supported position of the occupants head, facilitating activities such as TV viewing or reading and reducing strains associated with such activities and requirements of proping-up pillows.

15. In the adjustable assembly of claim 1
wherein a downward movement of the back support causes the head support to assume a flat position in line with the back support, and a further downward movement of the back support causes the head support to assume an inclined raised position in relation to the body supporting assembly by means such as members pushing from said holding frame or base to below the head support in a manner which permits only the downward movement of the portion of the head support near its pivoting point and thus creating an upward tilt of said head support.

16. In the assembly of claim 1, wherein a reversible mattress is secured to the assembly by means of a flap extending on each side to a mounting on the assembly, and said flap secured to the mattress in a manner providing the same flap length when mattress is reversed, in order to fit to the assembly mounting, and provided with retracting material for secure fastening of the mattress to the assembly.

17. In an adjustable body supporting assembly of claim 14 wherein the parts serving as knee and leg supports is divided into adjacent portions one for each side of two adjacent assemblies and each side is provided with separate power means for individual adjustment.

18. In the adjustable body supporting assembly of claim 17 wherein between the two lower portions, serving to elevate the knees and legs of occupants, a third separate portion composed of pivotally connected supports is pivotally mounted and provided with means both to elevate separately or jointly with the adjacent supports of both sides or to assume desired lower positions in relation to the adjacent supports.

19. In the assembly of claim 17, wherein in order to facilitate the lowering of the median assembly mounted between the said two lower assemblies, the joint upper layer such as upholstery or mattress is formed in its portion serving the three adjacent assemblies as three separately covered extentions of the main body or mattress.

* * * * *